United States Patent [19]

Peter

[11] Patent Number: 4,508,543

[45] Date of Patent: Apr. 2, 1985

[54] PROCESS FOR THE CATALYTIC GASIFICATION OF SOLID FLUIDS WITH STEAM

[75] Inventor: Siegfried Peter, Erlangen, Fed. Rep. of Germany

[73] Assignee: Kraftwerk Union Aktiengesellschaft, Fed. Rep. of Germany

[21] Appl. No.: 29,719

[22] Filed: Apr. 13, 1979

[30] Foreign Application Priority Data

Apr. 24, 1978 [DE] Fed. Rep. of Germany ..... 2817835

[51] Int. Cl.[3] ..... C10J 3/00

[52] U.S. Cl. ..... 48/197 R; 48/202; 252/373

[58] Field of Search ..... 48/202, 206, 210, 197 R, 48/214 A; 252/373; 423/650; 201/38

[56] References Cited

U.S. PATENT DOCUMENTS 2,543,795 3/1951 Mayer ..... 48/202
2,694,624 11/1954 Sweetser ..... 48/206

FOREIGN PATENT DOCUMENTS 2530600 1/1977 Fed. Rep. of Germany ..... 48/202

*Primary Examiner*—Peter Kratz
*Attorney, Agent, or Firm*—Wyatt, Gerber, Shoup, Scobey and Badie

[57] ABSTRACT

Disclosed is a process for gasifying solid carbon fuels with steam. After forming a supersaturated solution of catalyst in steam the pressure is reduced to reaction pressure.

11 Claims, No Drawings

PROCESS FOR THE CATALYTIC GASIFICATION OF SOLID FLUIDS WITH STEAM

German patent application No. P 25 30 600.7 (this application corresponds to U.S. patent application Ser. No. 703,239 filed July 7, 1976, now abandoned, which is the parent application of continuation-in-part application Ser. No. 862,205 filed Dec. 19, 1977) discloses a process for catalyzing the reaction between coal and steam by dissolving catalytically active compounds in high-pressure steam. As substances which, according to the process of the invention, are easily soluble in high-pressure steam and show good catalytic activity with respect to the reaction between coal and steam, there are mentioned alkali metal compounds such as hydroxides or salts, carbonates, chlorides, borates, acetates, and the like; as well as salts of alkaline earth metals such as chlorides, acetates etc. Alkaline earth metal hydroxides also result in acceleration of the reaction.

Solubility of the compounds in high-pressure steam will, however, drop rapidly with decreasing pressures so that the catalytic effect of the above process is especially evident only at pressures above 100 bar. As there is considerable interest in processes providing excellent acceleration even at lower pressures, working at pressures of from 40 to 70 bar seems to be desirable for various reasons, one of these reasons being, for instance, that the steam pressures available from light water reactors do not exceed 65 to 70 bar. Thus, if nuclear heat is to be employed in the gasifiers in order to improve upon the economy of the gasification operation, the available steam pressure will be restricted to the above value.

Solubility of the above mentioned catalytically active compounds in steam at 750° to 900° C. and 65 bar is relatively low. Some catalytic effect is still noticeable under these conditions but it is so low that an improvement or increase of the effect is urgently required. Surprisingly, the above difficulties may now be overcome by dissolving catalyst in steam at high pressures and subsequently feeding the steam into the reactor under release of pressure. Even though catalyst solubility will drop suddenly and drastically when the pressure of the steam is released and the concentration of saturation after pressure release is well below the catalyst concentration, the catalyst thus introduced into the coal bed remains highly active.

It is an object of the present invention to provide a process for the catalytic gasification of solid fuels with steam wherein the catalysts are first dissolved in high-pressure steam under conditions at which the catalyst/-steam system is supercritical, whereupon the pressure of the steam containing dissolved catalysts is reduced to reaction pressure.

In the process of the invention, there is formed an oversaturated solution of catalyst in steam and, respectively, a catalyst mist finely divided in steam.

Experiments have shown that catalysts thus introduced into the coal bed in form of an oversaturated solution or as finely divided mist will still be active after having passed through a filling layer of a height of 40 cm. or more. This proves that in layers of the above height, formation of methane from carbon monoxide and hydrogen and, respectively, coal and hydrogen is catalyzed and a corresponding increase in temperature is measured still. The mentioned catalytically active compounds accelerate not only the reaction between coal and steam under formation of carbon monoxide and hydrogen but any subsequent reactions as well. If catalyst-containing steam is fed in the above described manner to a coal bed externally heated to a constant temperature of e.g. 750° C., a temperature drop of about 50° C. may be observed in the steam feeding zone while the temperature increase in a zone about 30 to 40 cm. above the steam feeding zone amounts to about 70° C. On repeating the reaction without catalyst addition under otherwise identical conditions, one will observe a lower temperature drop in the steam feeding zone and the temperature increase above the steam feeding zone will be negligible.

The process of the present invention may also be realized in the following manner: Catalyst in an amount exceeding the actually required concentration is dissolved in steam at 400° C. and 220 bar, the steam thus being within the range of its critical temperature of 374.2° C. and its critical pressure of 217.5 bar and showing a correspondingly high density. Dissolution is readily accomplished because of the high density of the steam. Steam loaded with large amounts of catalyst is then led to the reactor and mixed at the reactor inlet with the main stream of steam which has been heated to reaction temperature. The temperature of the main stream may be sufficiently high to bring the temperature of the combined streams to the desired level of from 750° to 900° C. Here too, mixing of the two streams will result in formation of an oversaturated solution of catalyst and, respectively, a finely divided catalyst mist. The catalyst thus introduced into the reactor is highly active as it is capable of following the reaction front without any difficulty.

In another embodiment of the present invention, steam which contains dissolved catalyst and is preferably maintained 2° to 100° C. above its critical temperature is subjected to pressure release on being mixed with the main stream of steam. For instance, steam at a pressure of 220 bar, thus being within the range of its critical pressure, may be subjected to pressure release while being combined and mixed with the main stream having a pressure of 60 bar.

In a further embodiment, an aqueous solution of catalyst, preferably maintained 0° to 100° C. below its critical temperature of 374.2° C., is added to the main stream of steam within the reactor. Sudden vaporization or optionally vaporization on pressure release under simultaneous mixing with the main stream will result in the desired oversaturated solution and finely divided mist, respectively.

Mixing of the two vapor streams is suitably accomplished with the aid of an injector-type reactor. Here, the catalyst-containing steam and the main stream are guided concentrically so that the main stream envelops the catalyst-containing stream. A cylindrical baffle or guide element will promote mixing efficiency. Suitably, the two streams are mixed when entering the reactor at a point below the reaction zone.

The process of the invention is applicable to e.g. steam gasification of pit coal, lignite, oil coke, heavy oils, oil residues, oil shale and the like.

The following examples illustrate the process of the invention without being limitative. Unless stated otherwise, all percentages given are by volume.

EXAMPLE 1

Pit coal coke prepared by heating pit coal to 700° C. was ground and reacted with pure steam in an autoclave. At a pressure of 140 bar and a temperature of 850° C., there were obtained 2.4 liters NTP of gas per liter of coke charge per minute, the gas containing 55% of hydrogen, 11% of methane, 4% of carbon monoxide, and 30% of carbon dioxide after condensation of the steam.

In a second series of tests, ground coke was impregnated for one hour with a 0.2 molar solution of potassium carbonate in water. The solution was drained off and the ground coke dried and reacted with pure steam in an autoclave at 850° C. and 140 bar. Per liter of coke charge and per minute, there were obtained 2.5 liters NTP of a gas which, after condensation of the steam, contained 56% of hydrogen, 11% of methane, 4% of carbon monoxide, and 29% of carbon dioxide. Thus, considering measuring errors, reaction rate as well as composition of the gas had remained the same.

In a third series of experiments, a sample of the above coke was reacted at a pressure of 140 bar and a temperature of 850° C. with steam which had been prepared by vaporizing an aqueous 0.02 molar solution of potassium carbonate at 300 bar and 500° C. and was subjected to pressure release when entering the reactor. The flow rate in the pressure release valve and the line following the pressure release valve was so high that those portions of potassium carbonate insoluble in steam after pressure release and heating to reaction temperature were entrained with the steam in extremely finely divided form. It must be left undecided whether this resulted in an oversaturated solution of potassium carbonate in steam or in a very fine mist of potassium carbonate particles. Per liter of coke charge and per minute, there were obtained 5.8 liters NTP of a gas which, after condensation of steam, contained 56% of hydrogen, 11.5% of methane, 2% of carbon monoxide, and 30.5% of carbon dioxide. Thus, the reaction rate was more than twice as high as that obtained under otherwise identical conditions with coke impregnated with a solution having ten times the above potassium carbonate content.

EXAMPLE 2

Pit coal coke prepared by heating pit coal to 700° C. was ground and reacted for one hour with a 0.2 molar solution of potassium chloride in water. The solution was drained off and the coke dried and reacted with pure steam in an autoclave at 800° C. and a pressure of 70 bar. Per liter of coke charge and per minute, there were formed 2.4 liters NTP of a gas which, after condensation of steam, contained 58% of hydrogen, 8.5% of methane, 7% of carbon monoxide, and 26.5% of carbon dioxide.

In another series of experiments, a sample of the above coke was reacted in an autoclave at a pressure of 70 bar and a temperature of 800° C. with steam which had been prepared by vaporizing a 0.02 molar solution of potassium chloride at 300 bar and 500° C. and was subjected to pressure release when entering the reactor. The flow rate of the steam in pressure release valve and line was sufficiently high to effect entrainment of very finely divided particles of those potassium chloride portions which, after pressure reduction to 70 bar and heating to reaction temperature, were insoluble in steam. Again, it must be left undecided whether an oversaturated solution of potassium chloride in steam or a very fine mist of potassium chloride was formed in this manner. Oversaturation was so stable that the steam still contained considerable amounts of catalyst even after having passed through a coke charge having a height of 110 cm. When the process gas was cooled to condense excess water therefrom, a catalyst-containing solution was formed. Per liter of coke charge and per minute, there were obtained 5.2 liters NTP of a gas which, after condensation of steam, contained 58% of hydrogen, 10% of methane, 5% of carbon monoxide, and 27% of carbon dioxide. Thus, the reaction rate was more than doubled over that obtained under otherwise identical conditions with coke impregnated with solution, the potassium carbonate content of which was ten times higher.

EXAMPLE 3

Pit coal prepared by heating caking pit coal to 700° C. was ground and reacted with catalyst-containing steam in an autoclave at a pressure of 60 bar and a temperature of 800° C. The mixture of potassium chloride and sodium hydroxide serving as catalyst was distributed in steam in the following manner: An aqueous solution containing 0.1 mole of potassium chloride and 0.1 mole of sodium hydroxide per 1000 grams of water was vaporized under a pressure of 300 bar at 400° C. Under these conditions, the steam/catalyst system is supercritical at concentrations below the curve of its solution pressure diagram; this means that in the mentioned concentration range, the mixture of steam and salts will be present as one-phase mixture. The steam containing high concentrations of catalyst was concentrically introduced and mixed with steam at 850° C. and 60 bar flowing through a line and was subsequently fed into the reactor. The ratio of the two vapor streams was selected to give a mixed stream having a pressure of 60 bar and containing 0.02 moles of catalyst per 1000 grams of steam. On pressure release, the catalyst-containing steam originally maintained at a pressure of 300 bar will reach a state below its critical range, undergo an equilibrium decomposition and form a vapor phase which contains only minor amounts of dissolved catalyst besides solid catalyst particles. Surprisingly, the rate of nucleus formation and crystal growth is so low under these circumstances that no salt precipitation takes place in the pressure release valve and the catalyst is carried into the coke charge in such a finely divided form that it remains highly active.

Per liter of coke charge and per minute, there were obtained 3.8 liters NTP of a gas which, after condensation of steam, contained 64% of hydrogen, 2% of methane, 2% of carbon monoxide, and 32% of carbon dioxide. Experiments conducted with pure steam under identical conditions resulted in 1.6 liters NTP of a gas containing 62% of hydrogen, 2% of methane, 4% of carbon monoxide, and 32% of carbon dioxide after steam condensation. Thus, the reaction rate under use of catalyst was about twice as high as that achieved without the use of catalyst.

EXAMPLE 4

Ground pit coal was reacted with catalyst-containing steam in an autoclave at 800° C. and a pressure of 70 bar. The steam containing the catalyst had been prepared by vaporizing at 800° C. and 500 bar an aqueous solution containing 0.02 moles of KCl and 0.02 moles of LiCl per 1000 grams of water; pressure on the steam was reduced to 70 bar while the steam was fed into the reactor. After pressure release, the catalyst originally dissolved in high-pressure steam was present in form of an oversaturated solution. Oversaturation was so stable that the steam still contained considerable amounts of catalyst even after having passed through a coke charge having a height of 110 cm.

When the process gas was cooled to condense excess water therefrom, a catalyst-containing solution was formed. Per liter of coke charge and per minute, there were obtained 3.2 liters NTP of a gas containing 56% of hydrogen, 10% of methane, 4% of carbon monoxide, and 30% of carbon dioxide. Steam conversion under the mentioned conditions amounted to about 22%. If a sample of the above coke was reacted with pure steam at the same temperature and pressure and under identical conditions, there were obtained 2.1 liters NTP of gas per liter of coke charge and per minute, the gas containing 58.5% of hydrogen, 9% of methane, 5% of carbon monoxide, and 27.5% of carbon dioxide. Steam conversion in this case amounted to about 14%.

I claim:

1. In a process of a catalytic gasification of solid carbon fuels with steam employing steam volatile catalysts at high temperature and pressure, the improvement which comprises the steps of:

1. forming a supersaturated solution of the catalyst in steam under supercritical conditions of temperature and pressure;
2. reducing the pressure to a value below supercritical; and
3. contacting resulting catalyst containing steam with the carbon fuel to be gasified thereby accelerating the reaction between the coal and steam.

2. A process as in claim 1 in which the supersaturated solution is formed in a first stream of steam and the pressure is reduced by mixing the first stream with a second stream of steam which is maintained at a lower pressure.

3. A process as in claim 1 in which the supersaturated solution is formed at a temperature from 2° C. to 100° C. above the critical temperature of steam.

4. A process according to any one of claims 1 through 3 in which the concentration of the catalyst in the steam is from 0.001 to 0.5 mole per 1,000 grams of steam.

5. The process according to any one of claims 1 to 3 wherein carbonates, halides, borates, tetraborates, and hydroxides of alkali metals or mixtures thereof are used as catalysts.

6. The process according to any one of claims 1 to 3 wherein carbonates, halides, borates, tetraborates, and hydroxides of potassium are used as catalysts.

7. The process according to any one of claims 1 to 3 wherein carbonates, halides, borates, tetraborates, and hydroxides of sodium are used as catalysts.

8. The process according to any one of claims 1 to 3 wherein carbonates, halides, borates, tetraborates, and hydroxides of lithium are used as catalysts.

9. The process according to any one of claims 1 to 3 wherein mixtures of lithium chloride and potassium chloride are used as catalysts.

10. The process according to any one of claims 1 to 3 wherein mixtures of sodium borate or sodium tetraborate and potassium chloride are used as catalysts.

11. The process according to any one of claims 1 to 3 wherein mixtures of sodium carbonate and potassium chloride are used as catalysts.

* * * * *